US005777636A

United States Patent [19]

Naganuma et al.

[11] Patent Number: 5,777,636

[45] Date of Patent: Jul. 7, 1998

[54] LIQUID JET RECORDING APPARATUS CAPABLE OF RECORDING BETTER HALF TONE IMAGE DENSITY

[75] Inventors: Tohru Naganuma, Kanagawa; Masayuki Sato, Tokyo, both of Japan

[73] Assignee: Sony Corporation, Tokyo, Japan

[21] Appl. No.: 622,005

[22] Filed: Mar. 26, 1996

[30] Foreign Application Priority Data

Mar. 29, 1995 [JP] Japan ..... 7-071420
Jul. 28, 1995 [JP] Japan ..... 7-193367

[51] Int. Cl.[6] ..... B41J 29/38; B41J 2/045

[52] U.S. Cl. ..... 347/10; 347/20

[58] Field of Search ..... 347/10, 20, 21, 347/48, 100

[56] References Cited

U.S. PATENT DOCUMENTS

| | | | |
|---|---|---|---|
| 4,494,128 | 1/1985 | Vaught . | |
| 4,521,786 | 6/1985 | Bain . | |
| 5,453,767 | 9/1995 | Chang et al. | 347/10 |
| 5,461,403 | 10/1995 | Wallace et al. | 347/10 |
| 5,495,270 | 2/1996 | Burr et al. | 347/10 |
| 5,521,619 | 5/1996 | Suzuki et al. | 347/10 |
| 5,689,291 | 11/1997 | Tence et al. | 347/10 |

FOREIGN PATENT DOCUMENTS

| | | |
|---|---|---|
| 0 538 147 A2 | 4/1993 | European Pat. Off. . |
| 0 616 891 A1 | 9/1994 | European Pat. Off. . |
| WO 94/25279 | 11/1994 | WIPO . |

OTHER PUBLICATIONS

Patent Abstracts of Japan, vol. 007, No. 074 (M-203), 26 Mar. 1983 & JP 58001562 A (Canon KK), 6 Jan. 1983.

Patent Abstracts of Japan, vol. 005, No. 119 (M-081), 31 Jul. 1981 & JP 56058870 A (Ricoh Co Ltd), 22 May 1981.

Patent Abstracts of Japan, vol. 007, No. 120 (M-217), 25 May 1983 & JP 58038189 A (Tomoegawa Seishijiyo:KK), 5 Mar. 1983.

Patent Abstracts of Japan, vol. 014, No. 083 (M-0936), 16 Feb. 1990 & JP 01297259 A (Victor Co of Japan Ltd), 30 Nov. 1989.

*Primary Examiner*—Stuart N. Hecker
*Attorney, Agent, or Firm*—Hill & Simpson

[57] ABSTRACT

In a liquid jet recording apparatus, a stable ink ejection/recording operation is realized, and a natural image with improved multi-gradation is recorded. In the liquid jet recording apparatus for mixing a dilution liquid with ink quantified by utilizing displacement of a piezoelectric device in response to print data, and for ejecting a mixture fluid made by mixing the ink with the dilution fluid so as to perform a recording operation, when the ink is quantified, a rising speed of a signal applied to the piezoelectric device is selected to be lower than, or equal to 1V/microsecond.

4 Claims, 12 Drawing Sheets

LIQUID JET RECORDING APPARATUS CAPABLE OF RECORDING BETTER HALF TONE IMAGE DENSITY

BACKGROUND OF THE INVENTION

1. Field of the Invention

The present invention generally relates to a liquid jet recording apparatus for flying a mixture fluid made by mixing ink with a diluting fluid on a recording paper or the like to perform a printing operation. More specifically, the present invention is directed to an ink jet printer capable of improving the density modulation recording technique.

2. Description of the Related Art

Conventionally, so-termed "on-demand type ink jet printers" are such printers capable of ejecting or jetting ink droplets from nozzles in response to a recording signal so as to record print data on a recording medium such as a paper and a film. Since the on-demand type ink jet printers can be made compact and in low cost, this type of printers are rapidly widely utilized in the field.

On the other hand, very recently, document formations with employment of computers, so-called as "desk top publishing" are popularized especially in offices. Also, currently, other demands are increasingly made by which not only characters/figures, but also color natural images such as pictures are outputted in combination with the relevant characters and figures. To print out such a natural image with a high grade, it is very important to reproduce a half tone image.

In this on-demand type ink jet printer, for instance, the two-fluid mixing/density modulating method has been proposed so as to reproduce such a half tone image. In accordance with this two-fluid mixing/density modulating method, one of the two fluids, namely the transparent solvent functioning as the dilution fluid and the ink, for instance, this ink is quantified in conformity with desirable gradation. Then, the quantified ink is mixed with the other fluid, namely the transparent solvent, and thereafter a constant amount of this mixture fluid is ejected for the recording purpose.

As the quantifying means, the signals produced in response to the density data about the respective pixels are converted into the corresponding voltage values (i.e., digital-to-analog conversion), the converted analog voltage signals are applied to the piezoelectric device in a rectangular form, and then, either the ink or the transparent solvent is extruded in accordance with the displacement amount of this piezoelectric device by way of the electric/mechanical converting effect of this piezoelectric device.

However, according to this quantifying method, when the voltage value applied to the piezoelectric device provided on the quantification side is increased in response to the density data, the recording stability would be deteriorated due to disturbances of the ink ejections. That is, when the high voltage pulse is applied to the piezoelectric device provided on the ink quantification side so as to represent high density, in the externally mixing type fluid jet recording apparatus, the speed when the quantifying ink is extruded is increased. As a result, since the quantifying ink depresses the ejecting ink, there is a variation in the flying direction of the droplets of the mixture fluid.

In the worst case, there are some possibilities that the quantified ink and the ejected transparent solvent would fly in different directions. As a result, the recorded image would be deteriorated. Also, when the speed when the quantifying ink is extruded is increased in the internally mixed type fluid jet recording apparatus, turbulent flows may occur in the mixing unit. As a consequence, since the ejection direction of the mixture fluid is changed, the recorded image would be deteriorated.

OBJECTS AND SUMMARY OF THE INVENTION

The present invention has been made to solve the various problems of the above-described conventional fluid jet recording apparatuses, and therefore, has an object to provide a liquid jet recording apparatus capable of setting a flying direction of droplets of a mixed fluid in a stable condition, and capable of producing an image recorded in a better image recorded in a better image quality.

According to the present invention, a liquid jet recording apparatus is to mix a dilution liquid with ink quantified by utilizing displacement of a piezoelectric device in response to print data, and to eject a mixture fluid made by mixing the ink with the dilution fluid so as to perform a recording operation.

When the ink is quantified, a rising speed of a signal applied to said piezoelectric device is selected to be lower than, or equal to 1V/microsecond, in order to stabilize the flying direction of the droplets of the mixed fluid. Preferably, this speed is selected to be lower than, or equal to 0.25V/microsecond.

When either the ink or the dilution fluid is quantified, the change ratio of pressure given to either the ink or the dilution fluid is selected to be lower than, or equal to $1\times10^6$ N/m$^2$ microsecond, preferably $0.25\times10^6$ N/m$^2$ microseconds, while controlling the signal applied to the piezoelectric device. In this case, the change ratio of pressure implies that the pressure change becomes $1\times10^6$ N/m$^2$ microsecond within 1 microsecond. When the lower limit value is considerably reduced, the printing speed would be delayed. Accordingly, this allowable lower limit value may be obviously determined based upon the apparatus performance.

In this specification, such a fluid jet recording apparatus is referred to as an "externally mixing type fluid jet recording apparatus" in which an outlet port of a first flow path provided for a transparent solvent, and an outlet port of a second flow path provided for ink are positioned close to each other, a mixture fluid is produced outside these outlet ports, and then this mixture fluid is ejected by utilizing the ejection output of the transparent solvent. On the other hand, such a fluid jet recording apparatus is referred to as an "internally mixing type fluid jet recording apparatus" in which a first flow path for a transparent solvent is intersected with a second flow path for ink to thereby for a third flow path, a mixture fluid is formed at the intersect portion between the first flow path and the second flow path, and this mixture fluid passes through the third flow path and is ejected.

It should be understood that wither the externally mixing type apparatus or the internally mixing type apparatus may be utilized as the fluid jet recording apparatus in this specification. The externally mixing type fluid-jet recording apparatus is so arranged that an outlet port of a first flow path provided for a transparent solvent, and an outlet port of a second flow path provided for ink are positioned close to each other, a mixture fluid is produced outside these outlet ports, and then this mixture fluid is ejected by utilizing he ejection output of the transparent solvent.

On the other hand, the internally mixing type fluid jet recording apparatus is so arranged that a first flow path for a transparent solvent is intersected with a second flow path for ink to thereby for a third flow path, a mixture fluid is formed at the intersect portion between the first flow path and the second flow path, and this mixture fluid passes through the third flow path and is ejected.

In accordance with the present invention, the rising speed of the pulse signal used to quantify either the ink or the dilution fluid is selected to be lower than, or equal to 1V/microsecond. In this speed range, since the adverse influence caused by the speed when either the ink or the dilution fluid is extruded and given to the ejection direction of either the ink or the dilution fluid can be neglected, the flying directions of the droplets of the mixed fluids are stabilized irrelevant to the recording density, and thus the images with better image quality can be continuously produced.

Also, according to the present invention, the change rate of pressure given to either the ink or the dilution fluid when either the ink or the dilution fluid is quantified is selected to be lower than, or equal to $1\times10^6$ N/m$^2$ microsecond, while controlling the signal applied to the piezoelectric device. In this speed range, since the advance influence caused by the speed when either the ink or the dilution fluid is extruded and given to the ejection direction of either the ink or the dilution fluid can be neglected, the flying directions of the droplets of the mixed fluids are stabilized irrelevant to the recording density, and thus the images with better image quality can be continuously produced.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERRED EMBODIMENTS

Referring now to drawings, a liquid jet recording apparatus according to a preferred embodiment of the present invention will be described in detail.

FIRST INK JET RECORDING APPARATUS

In this first embodiment, the present invention is applied to an externally mixing type liquid jet recording apparatus (print head). In this print head, ink is provided on the quantification side, and a dilution fluid is provided on the ejection side. A mixture fluid made from the ink and the dilution fluid is jetted, or ejected toward a recording paper and the like. This liquid jet recording apparatus is so-called as a "carrier jet type liquid jet recording apparatus".

Figure 1:
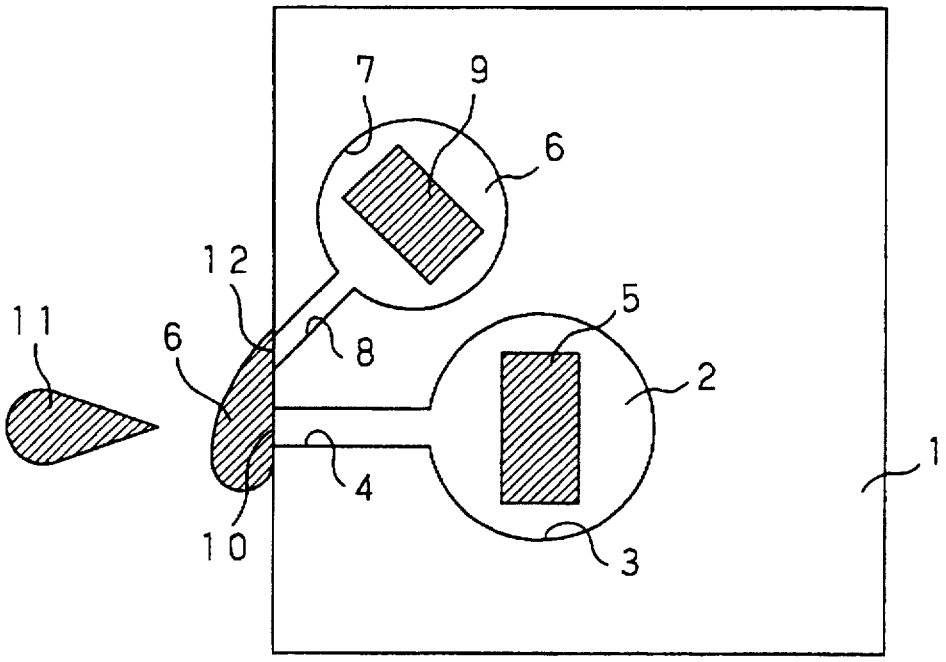
FIG. 1 schematically illustrates an externally mixing type liquid jet recording apparatus.

As indicated in FIG. 1, the liquid jet recording apparatus 1 is arranged by a transparent solvent storage unit 3 for storing transparent solvent 2 corresponding to the dilution fluid, a first flow path 4 for ejecting this transparent solvent 2, a first piezoelectric device 5 functioning as a means for supplying the transparent solvent 2 to this first flow path 4, an ink storage unit 7 for storing ink 6, a second flow path 8 used to conduct the quantified ink 6 to an ejection port so as to mix this quantified ink 6 with the transparent solvent 2, and a second piezoelectric device 9 functioning as a means for supplying the ink 6 to this second flow path 8.

In the transparent solvent storage unit 3, the transparent solvent 2 is filled which corresponds to such a dilution fluid used to be mixed with the ink 6 so as to density of this ink 6. As this transparent solvent 2, for instance, water is employed.

One end of the first flow-path 4 is connected to the transparent solvent storage unit 3, and the other end thereof is connected to a transparent solvent ejection port 10. The transparent solvent 2 quantified by the first piezoelectric device 5 provided opposite to the transparent solvent storage unit 3 is supplied to this first flow path 4.

Then, this first piezoelectric device 5 not only has such a function to quantize the transparent solvent 2 to thereby supply the quantized transparent solvent 2 to the first flow path 4, but also has another function to eject the mixture fluid 11 made by mixing the ink 6 with the transparent solvent 2 toward such a recording medium as a recording paper.

On the other hand, the ink such as yellow ink, cyan ink, magenta ink, and black ink is filled with the ink storage unit 7.

The second flow path 8 is positioned inclined with respect to the first flow path 4. One end of the second flow path 8 is connected to the ink storage unit 7, and the other end thereof is connected to the ink ejection port 12. This ink ejection port 12 is provided at a position near the transparent solvent ejection port 10 so as to mix the ink with the transparent solvent 2.

The second piezoelectric device 9 is positioned opposite to the ink storage unit 7 in order that the ink stored in this ink storage unit 7 is supplied to the second flow path 8.

Figure 3:
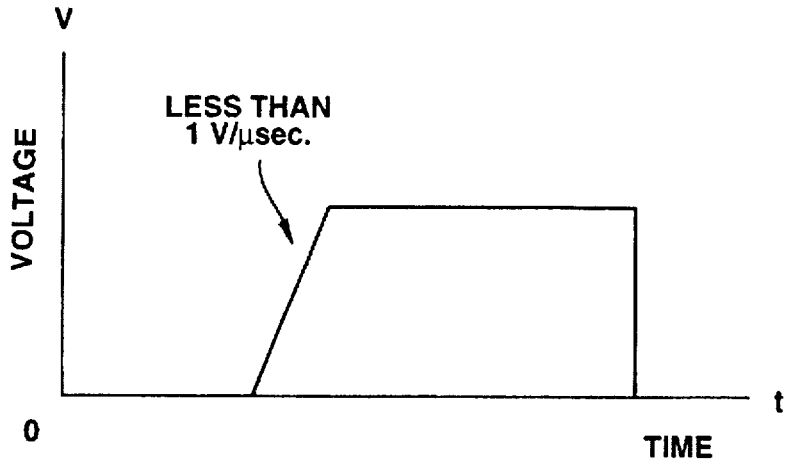
FIG. 3 schematically represents a drive waveform of a piezoelectric device.

In the liquid jet recording apparatus with the above-described arrangement, in order to eject fluid droplets which have been density-modulated, such a drive pulse whose crest value is changed based on print data is first applied to the second piezoelectric device 9. At this time, a drive circuit (not shown) produces such a pulse whose rising speed is controlled to be less than, or equal to 1V/microsecond, preferably 0.25V/microsecond (see FIG. 3), irrelevant to the crest value (peak value) of the pulse. The second piezoelectric device 9 is driven by this pulse. As a result, a preselected amount of the ink 6 passes through the second flow path 8, and then is extruded in front of the transparent solvent ejection port 10.

Since the influence given by the extruding speed of the ink 6 to the ejection direction of the transparent solvent 2 can be neglected in this speed range, the flying directions of the mixed fluid droplets become stable irrelevant to the density, so that images having better image qualities can be continuously obtained.

Next, an ejecting drive pulse is applied to the first piezoelectric device 5, and thus the transparent solvent 2 is ejected through the first flow path 4. As the ink 6 is present at the exist port of the first flow path 4, this transparent solvent 2 is mixed with the ink 6 immediately before the ejection, so that the mixture fluid 11 made from the transparent solvent 2 and the ink 6 is ejected.

With respect to a series of the above-described operations, the rising speed of the drive pulse for extruding the ink 6 is controlled in such a manner that the ejection direction of the transparent solvent 2 is not changed by the extruding speed of the ink 6 is not ejected. As a consequence, the mixing condition and also the ejecting direction of the mixture fluid 11 can be continuously made stable.

SECOND FLUID JET RECORDING APPARATUS

In this second embodiment, the present invention is applied to an internally mixing type liquid jet recording apparatus. In this print head, ink is provided on the quantification side, and a dilution fluid is provided on the ejection side. A mixture fluid made from the ink and the dilution fluid is jetted, or ejected toward a recording paper and the like. This liquid jet recording apparatus is so-called as a "carrier jet type liquid jet recording apparatus".

The above-explained liquid jet recording apparatus 13 is similar to the previously-described externally mixing type liquid jet recording apparatus except for such a structure that the first flow path 4 to which the transparent solvent 2 is supplied is intersected with the second flow path 8 to which the ink 6 is supplied before the mixture fluid 11 is ejected.

As a result, it should be noted that the same reference numerals shown in the externally mixing type fluid jet recording apparatus of FIG. 1 will be employed as those for denoting the same or similar structural components of the second embodiment, and explanations thereof are omitted.

Figure 2:
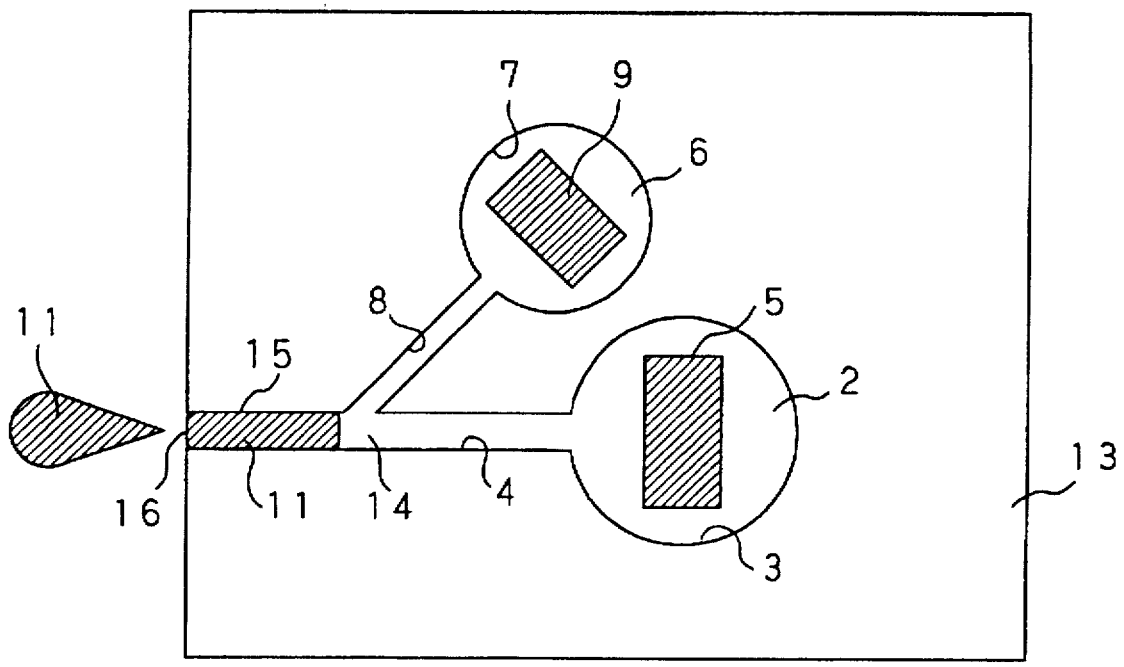
FIG. 2 schematically shows an internally mixing type liquid jet recording apparatus.

As represented in FIG. 2, the first flow path 4 is intersected with the second flow path 8 before the mixture fluid 11 is ejected. In other words, the second flow path 8 is provided in such a way that this second flow path 8 is intersected with the first flow path 4 having a straight shape in an inclined manner and is branched from the first flow path 4. This branching portion between the first flow path 4 and the second flow path 8 constitutes a mixing portion 14 for mixing the ink 6 with the transparent solvent 2.

The mixture fluid 11 mixed in this mixing portion 14 passes through a third flow path 15 provided on the extension line of the first flow path 4, and then is ejected from the mixture fluid ejection port 16 to the recording medium such as the recording paper.

In the liquid jet recording apparatus with the above-described arrangement, in order to eject fluid droplets which have been density-modulated, as similar to the first embodiment, such a drive pulse whose crest value is changed based on print data is first applied to the second piezoelectric device 9. At this time, a drive circuit (not shown) produces such a pulse whose rising speed is controlled to be less than, or equal to 1V/microsecond, preferably 0.25V/microsecond (see FIG. 3), irrelevant to the crest value (peak value) of the pulse. The second piezoelectric device 9 is driven by this pulse. As a result, a preselected amount of the ink 6 passes through the second flow path 8, and then is extruded into the mixing portion 14 in front of the transparent solvent ejection port 16.

Since the influence given by the extruding speed of the ink 6 to the ejection direction of the transparent solvent 2 can be neglected in this speed range, the flying directions of the mixed fluid droplets become stable irrelevant to the density, so that images having better image qualities can be continuously obtained.

Next, an ejecting drive pulse is applied to the first piezoelectric device 5, and thus the transparent solvent 2 is ejected through the first flow path 4. Then, this transparent solvent 2 is mixed with the ink 6 existing in the mixing portion 14 to constitute the mixture fluid 11. Thereafter, this mixture fluid 11 passes through the third flow path 15 and is ejected from the mixture fluid ejection port 16 to the recording medium of the recording paper.

With respect to a series of the above-described operations, the rising speed of the drive pulse for extruding the ink 6 is controlled in such a manner that the ejection direction of the transparent solvent 2 is not changed by the extruding speed of the ink 6, but also only the ink 6 is not ejected. As a consequence, the mixing condition and also the ejecting direction of the mixture fluid 11 can be continuously made stable.

It should also be noted that although the above-described two examples are related to the carrier jet type liquid jet recording apparatuses in which the dilution fluid, the present invention may be applied to such a so-called "ink jet type liquid jet recording apparatus" in which the dilution fluid is provided on the quantification side and the ink is provided on the ejection side, and then the mixture fluid made of these fluids is ejected toward the recording paper, resulting in a similar advantage. In other words, the first flow path 4 corresponding to the ejection side is filled with the ink 6, the second flow path 8 corresponding to the quantification side is filled with the transparent solvent 2, and when the transparent solvent 2 is quantified, the rising speed of the signal applied to the piezoelectric device is selected to be less than, or equal to 1V/microsecond, preferably 0.25V/microsecond.

THIRD FLUID JET RECORDING APPARATUS

In this third embodiment, the present invention is applied to an externally mixing type liquid jet recording apparatus. In this print head, ink is provided on the quantification side, and a dilution fluid is provided on the ejection side. A mixture fluid made from the ink and the dilution fluid is jetted, or ejected toward a recording paper and the like. This liquid jet recording apparatus is so-called as a "carrier jet type liquid jet recording apparatus". Furthermore, the mixture fluid is ejected in such a direction along which pressure of a piezoelectric device is applied.

Figure 4:
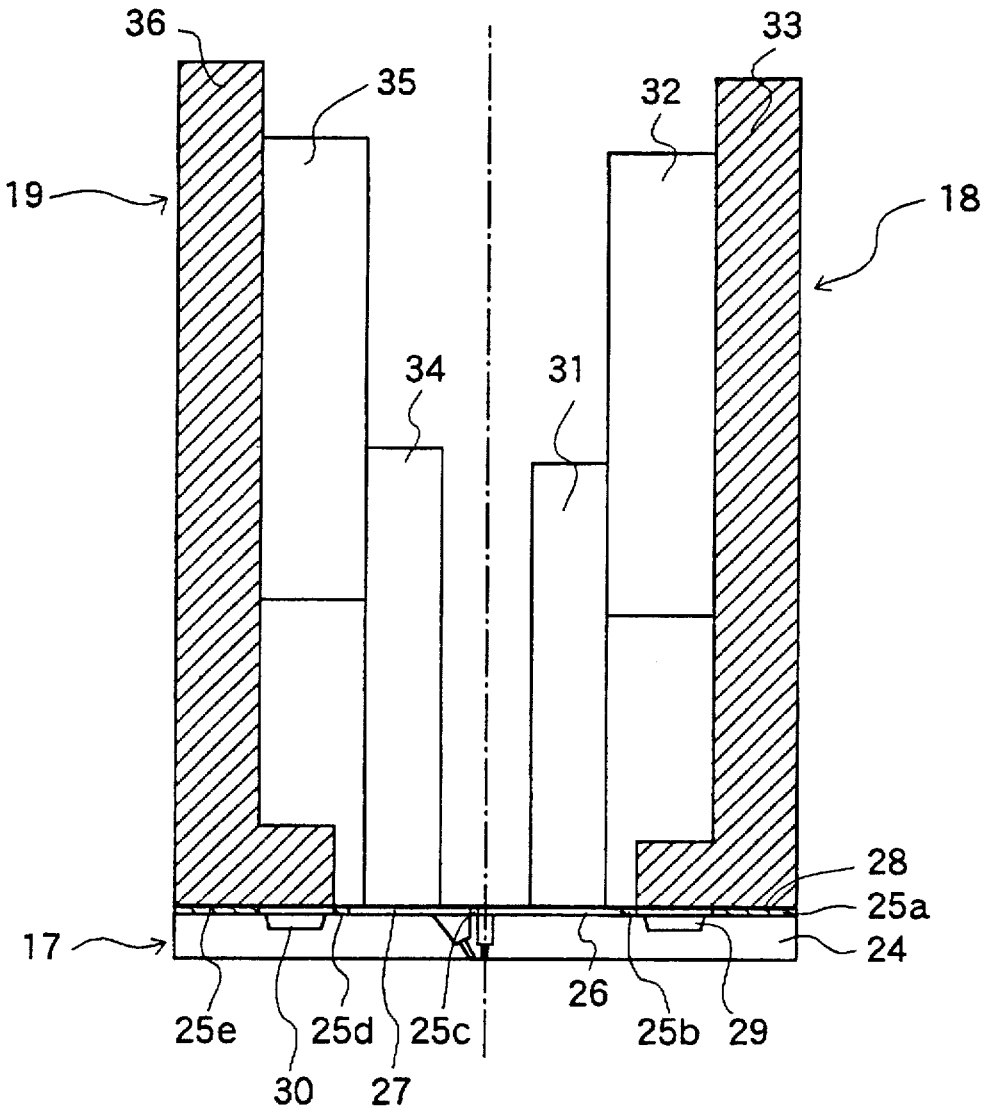
FIG. 4 is a sectional view for indicating an overall structure of a liquid jet recording apparatus, according to a preferred embodiment of the present invention.

As illustrated in FIG. 4, this liquid jet recording apparatus is arranged by a pressure chamber unit 17 corresponding to a cavity unit having two pressure chambers for mainly mixing ink with a dilution fluid to eject the mixture fluid, and a first piezoelectric unit 18, and also a second piezoelectric unit 19, corresponding to the above-explained two pressure chambers.

Figure 5:
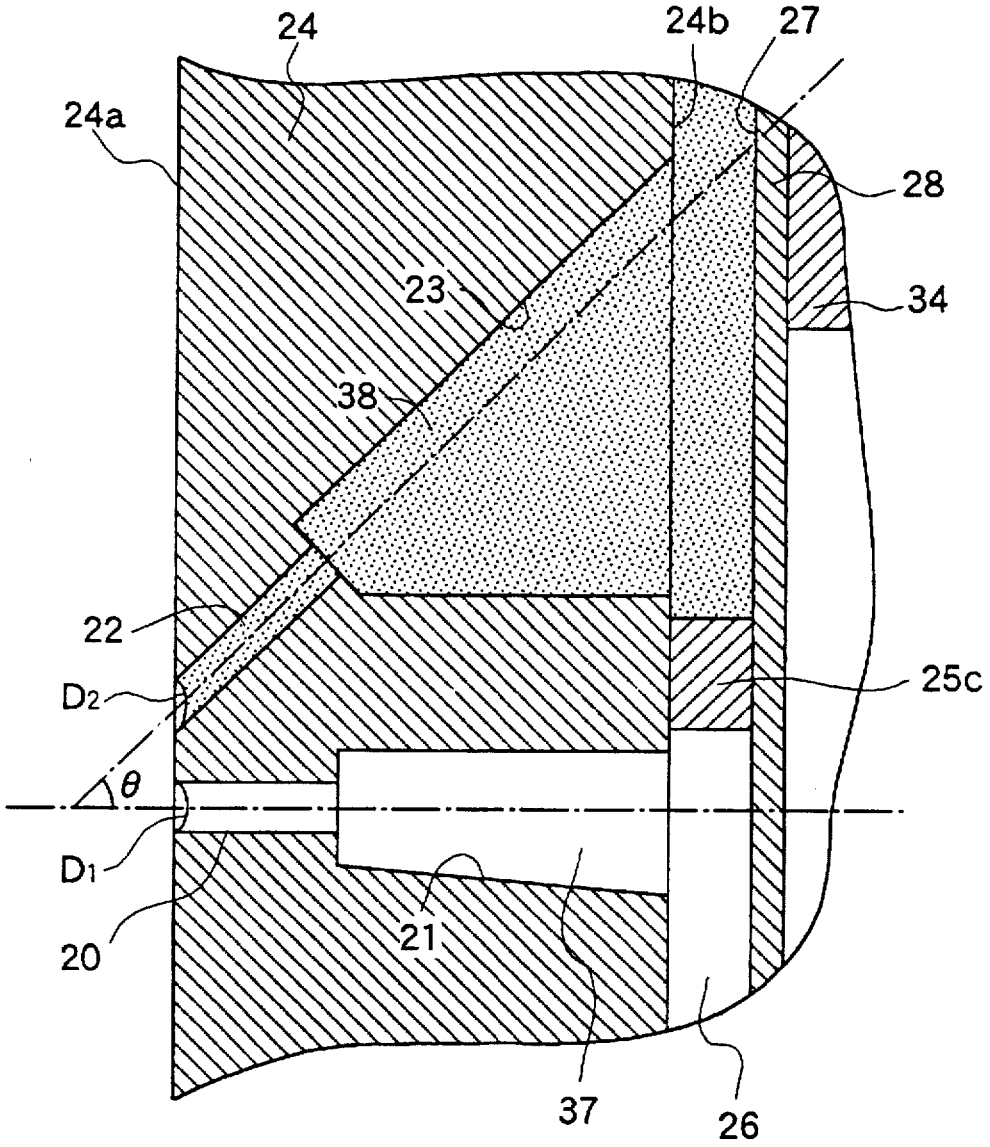
FIG. 5 is a sectional view for indicating a pressure chamber unit portion of the liquid jet recording operations.

As described above, the pressure chamber unit 17 is used to mix the ink with the dilution fluid and then to eject the mixture fluid. As shown in FIG. 5 in an enlarging form, within this pressure chamber unit 17, a plate-shaped orifice plate 24, and pressure chamber side walls 25*a*, 25*b*, 25*c*, 25*d*, 25*e* are formed as a separate wall as shown in FIG. 4. In this orifice plate 24, there are formed at a near center, a first nozzle 20 functioning as an ejection port for a dilution fluid, a first conducting port 21 communicated with this first nozzle 20, a second nozzle 22 functioning as an ejection port for ink, and a second conducting port 23 communicated with the second nozzle 22. Then, the pressure chamber unit 17 is arranged by a first pressure chamber 26 functioning as a flow path for the dilution fluid, a second pressure chamber 27 functioning as a flow path for the ink, and a vibration plate 28.

In this orifice plate 24, as shown in FIG. 5 in the enlarged manner, one ends of the first and second nozzles 20 and 22 are faced opposite to one major surface 24*a* constituting a print surface, whereas one ends of the first and second conducting ports 21 and 23 communicated to the first and second nozzles 20 and 22 are faced opposite to another major surface 24*b* opposite to the first-mentioned major surface 24*a*. As a consequence, both the first conducting port 21 and the first nozzle 20 entirely penetrate through the orifice plate 24, and both the second conducting port 23 and the second nozzle 22 entirely penetrate through the orifice plate 24. The first and second nozzles 20 and 22 are fabricated in such a manner that an angle "θ" between these nozzles along the opening direction thereof, as shown in FIG. 5, is defined as 45 degrees.

Furthermore, as indicated in FIG. 4, in this orifice plate 24, a first supply chamber 29 having a cross-sectional shape of "]" which will constitute a dilution fluid reservoir, and a second supply chamber 30 having a cross-sectional shape of "]" which will constitute an ink reservoir are fabricated in such a manner that opening portions thereof are faced to the other major surface 24*b* opposite to one major surface 24*a* which constitutes the print surface, while sandwiching the first nozzle 20, the second nozzle 22, the first conducting port 21 and the second conducting port 23.

At this time, pressure chamber side walls 25*a*, 25*b*, 25*c*, 25*d* are formed in a stacked manner as an isolate wall on the major surface 24*b* of the orifice plate 24. The opening portion of the first supply chamber 29 is connected to the opening portion of the first conducting portion 21 by such a portion of the orifice plate 24 where the above-described pressure chamber side walls 25*a*, 25*b*, 25*c*, 25*d* are not fabricated, so that a first pressure chamber 26 which may constitute a flow path is fabricated. Also, the opening portion of the second supply chamber 30 is connected to the opening portion of the second conducting portion 23 by the above-described portion of the orifice plate 24 to thereby form a second pressure chamber 27 which may constitute a flow path. Then, the vibration plate 28 is stacked on the pressure chamber side walls 25*a*, 25*b*, 25*c*, 25*d*, so that the first and second pressure chambers 26 and 27 are tightly sealed.

The above-mentioned first piezoelectric unit 18 is constituted by a first plate-shaped laminated (stacked) piezoelectric device 31 for alternating laminating piezoelectric materials and conductive materials, a first supporting member 32 for fixing one end portion of the first laminated piezoelectric device 31, and a first holder 33 for fixing the first supporting member 32 by which the first laminated piezoelectric element 31 is fixed with respect to the pressure chamber unit 17. A similar structure is applied to the second piezoelectric unit 19. That is, a second laminated piezoelectric device 34 is fixed to one end of a second supporting member 35, which are fixed to the pressure chamber unit 17 by way of a second holder 36.

As the above-described first and second laminated piezoelectric devices 31 and 34, the piezoelectric materials and the conductive materials may be laminated or stacked along a direction perpendicular to the longitudinal directions of the first and second pressure chambers 26 and 27, otherwise along a direction parallel to the longitudinal direction. A laminated piezoelectric device owns such a characteristic that when a voltage is applied thereto, this laminated piezoelectric device is expanded along a laminated direction. As a result, the first-mentioned laminated piezoelectric element 31 is expanded along the longitudinal directions of the first and second pressure chambers 26 and 27 when the voltage is applied, and is shrunk along an upper direction perpendicular to this expanding direction, as viewed in FIG. 4. As a consequence, this laminated piezoelectric device does not give any pressure to the pressure chambers. Such a piezoelectric device will be referred to as a "$d_{31}$" mode hereinafter. On the other hand, the second-mentioned laminated piezoelectric device 34 is expanded along a direction perpendicular to the longitudinal directions of the first and second pressure chambers 26 and 27, which may give pressure to the pressure chambers. Such a piezoelectric device will be referred to as a "$d_{33}$" mode hereinafter.

Then, the first laminated piezoelectric device 31 is positioned opposite to the first pressure chamber 26 via the vibration plate 28, and the second laminated piezoelectric device 34 is similarly positioned opposite to the second pressure chamber 30 via the vibration plate 28.

As a result, in the liquid jet recording apparatus with such an arrangement, for instance, the dilution fluid is supplied from a dilution fluid tank (not shown) via either a supply pipe (not shown) or a supply groove (not shown either) to the first supply chamber 29 from which the dilution fluid passes through the first pressure chamber 26 and is then filled into the first nozzle 20 communicated with the first conducting port 21, as shown in FIG. 5. By this dilution fluid 37, a first meniscus D1 is formed at the tip portion of the first nozzle 20.

On the other hand, similar to the above-described dilution fluid, the ink is supplied from an tank (not shown) via either a supply pipe (not shown) or a supply groove (not shown either) to the second supply chamber 30 from which the ink passes through the second pressure chamber 27 and is then filled into the second nozzle 20 communicated with the second conducting port 23, as shown in FIG. 5. By this ink 38, a second meniscus D2 is formed at the tip portion of the second nozzle 22.

In the case that the printing operation is carried out by the liquid jet recording apparatus with such an arrangement, an application timing of a drive voltage is shown in FIG. 6 when a so-called "$d_{33}$ mode" of laminated piezoelectric device is employed as, for example, the first and second laminated piezoelectric devices 31 and 34.

Figure 6A:
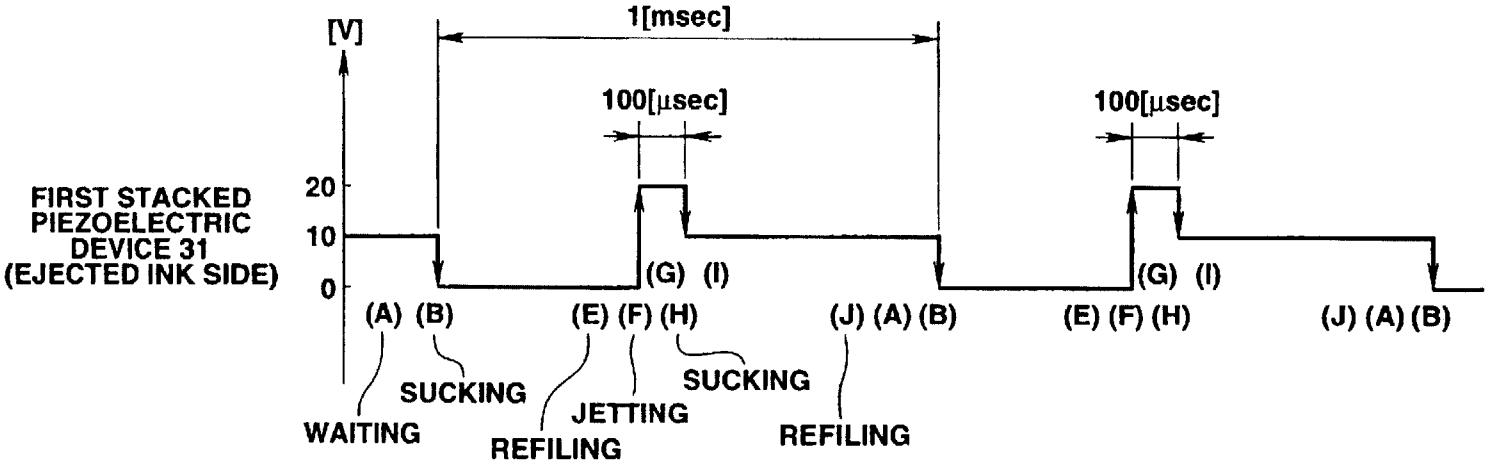
FIGS. 6A and 6B are a timing chart for representing one example of application timings of drive voltages.

That is, as represented in FIG. 6A, in the waiting condition before the printing operation, for instance, 10 [V] is previously applied to the first laminated piezoelectric device 31 at a same instant indicated by a symbol (A) in this drawing. Then, during the printing operation, in order to firstly suck, or draw the dilution fluid 37 into the first nozzle 20 in response to signals from the head drive, the head feed control, and the drum rotation control, the voltage applied to the first laminated piezoelectric device 31 is set to 0 [V] at a time instant indicated by a symbol (B). As a result, the first laminated piezoelectric device 31 is shrunk to thereby increase the volume of the first pressure chamber 26, so that the inner pressure of this first pressure chamber 26 becomes negative pressure; and therefore the dilution fluid 37 is sicken into the first nozzle 20.

Figure 6B:
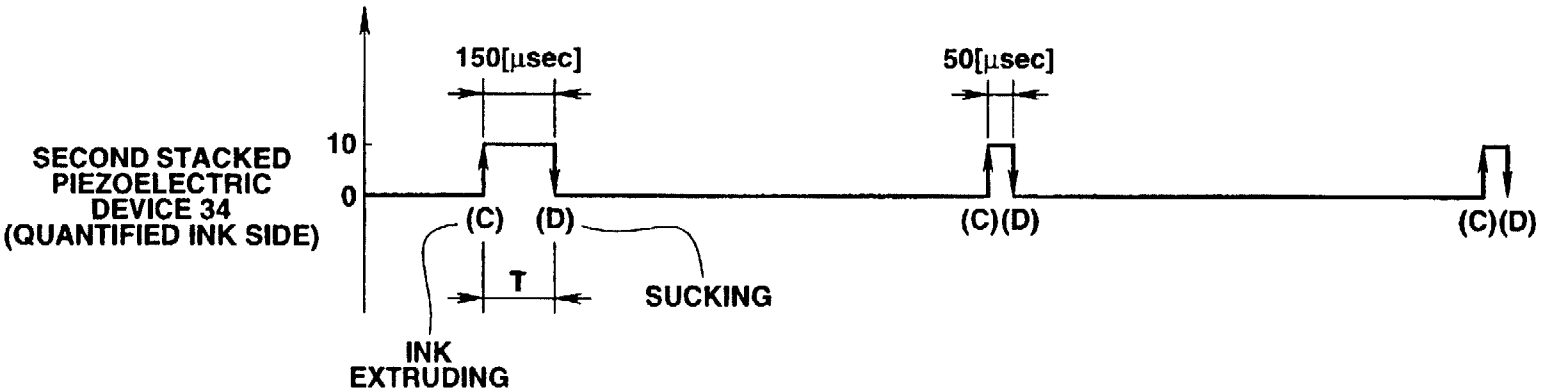

Then, at the same time, or after a small delay, as indicated in FIG. 6B, for example, a drive voltage of 10 V is applied to the second laminated piezoelectric device 34 for 150 microseconds at a time instant denoted by a symbol (C) in this drawing in order that the ink 38 is extruded from the second nozzle 22 and then seeps from this second nozzle 22. Thus, the second laminated piezoelectric device 34 is expanded along the longitudinal direction thereof to thereby apply pressure via the vibration plate 28 to the second pressure chamber 27 and apply the inner pressure to the second nozzle 22.

Accordingly, the ink 38 will seep from the outside of the second nozzle 22 up to the opening portion of the first nozzle 20, so that the ink 38 is quantified. Thereafter, in order to suck the ink 38 into the second nozzle 22, when the drive voltage applied to the second piezoelectric device 34 is decreased to 0 V at a time instant indicated by a symbol (D) in this drawing, the ink left on one major surface 24*a* of the orifice plate 24 is sicken into the second nozzle 22 to thereby form the second meniscus D2.

It should be understood that a pulse width of an ink quantifying pulse indicated by a symbol "T" of FIG. 6B and defined between the time instant. (C) and the time instance (D) is variable.

Furthermore, in order to eject the dilution fluid 37 refiled into the first nozzle 20 under this condition, as indicated in FIG. 6A, for instance, a drive voltage of 20 V is applied to the firstly laminated piezoelectric device 31 for 100 microseconds from a time instant denoted by a symbol (E), i.e., under refiling condition, to a time instant indicated by a symbol (F), and then the pressure is applied via the vibration plate 28 to the first pressure chamber 26, and also the negative pressure is applied to the first nozzle 20.

As a result, the dilution fluid 37 is extruded by the negative pressure produced in the first nozzle 20 at a time instant (G), and then the above-described quantified ink 38 is mixed with this dilution fluid 37. Thus, the mixed fluids are ejected as liquid droplets having preselected density, and then the liquid droplets are attached to the print paper for the printing operation.

Thereafter, in order to suck the dilution fluid 37 into the first nozzle 20, when the drive voltage of the first laminated piezoelectric device 31 is lowered to 10 V at a time instant "H" shown in FIG. 6A, the inner pressure of the first pressure chamber 26 and the inner pressure of the first nozzle 20 are brought into negative pressure, because the shrinkage of the first laminated piezoelectric device 31. As a consequence, the dilution fluid is sicken into the first nozzle 20. Subsequently, the inner pressure of the first pressure chamber 26 and the inner pressure of the first nozzle 20 are gradually returned to the original pressure values. At time instants (I) and (J) shown in FIG. 6A, the dilution fluid 37 is refilled into the first nozzle 20 due to the capillary phenomenon to thereby form the first meniscus. Then, as indicated in FIG. 6A and FIG. 6B the above-described operation is repeated to thereby perform the printing operation.

Figure 7A:
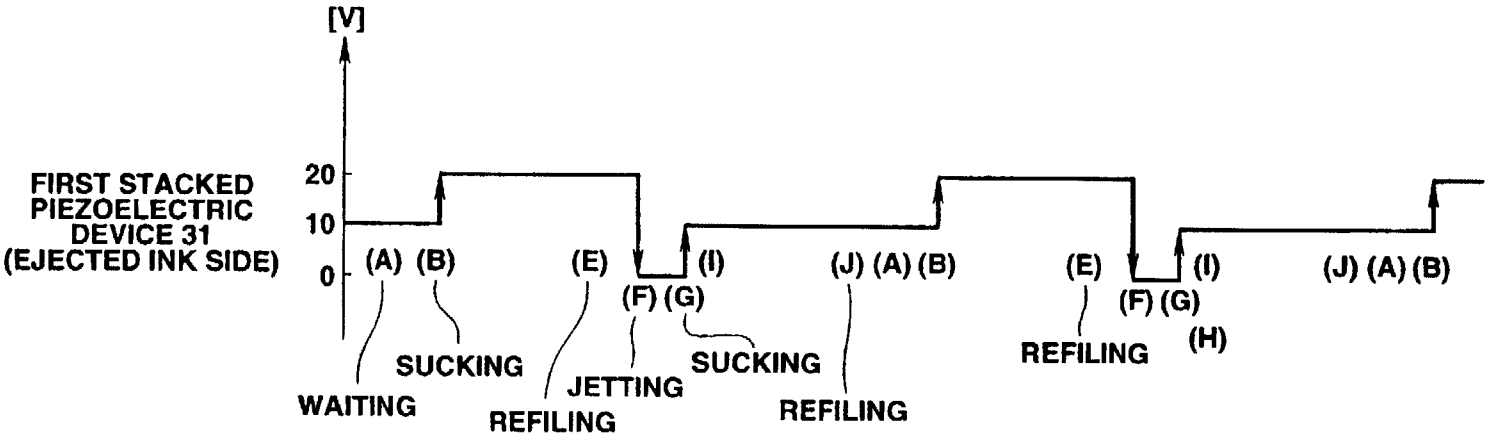
FIGS. 7A and 7B shows a timing chart for describing another example of application timings of drive voltages.
Figure 7B:
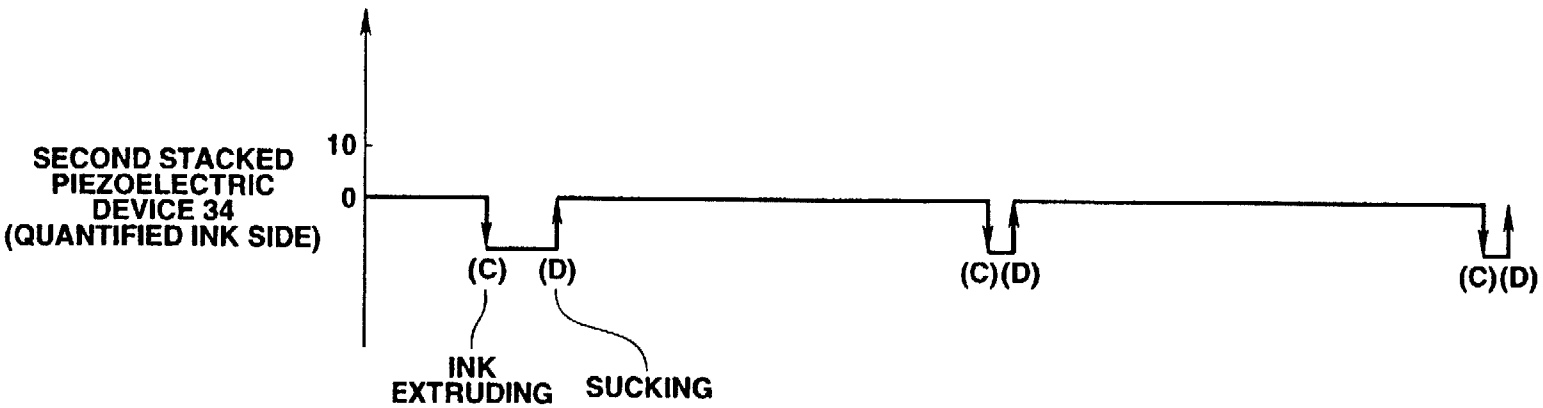

An application timing of a drive voltage is indicated in FIG. 7 when a so-called "$d_{31}$ mode" laminated piezoelectric device is utilized as the first and second laminated piezoelectric device 31 and 34. Since this $d_{31}$ mode laminated piezoelectric device is shrunk by applying the voltage thereto along the direction perpendicular to the longitudinal directions of the first and second pressure chambers 26 and 27, this $d_{31}$ mode laminated piezoelectric device represents such behavior completely opposite to that of the above-explained $d_{33}$ mode laminated piezoelectric device. As a consequence, the application timing of the drive voltage to the $d_{31}$ mode laminated piezoelectric device corresponds to the inverted application timing of the drive voltage as shown in FIG. 6 when the $d_{33}$ mode laminated piezoelectric device is employed.

It should be noted that as the materials of the orifice plate 24, the pressure chamber side walls 25*a*, 25*b*, 25*c*, 25*d*, 25*e*, and the vibration plate 28, a resin such as a resin of polysulfone; a dry film resist; and a metal plate such as nickel may be employed. Also, the orifice plate 24 may be manufactured by injection-molding the above-described resin, whereas the first and second nozzles 20, 22 may be formed by way of the eximer laser processing.

Figure 8:
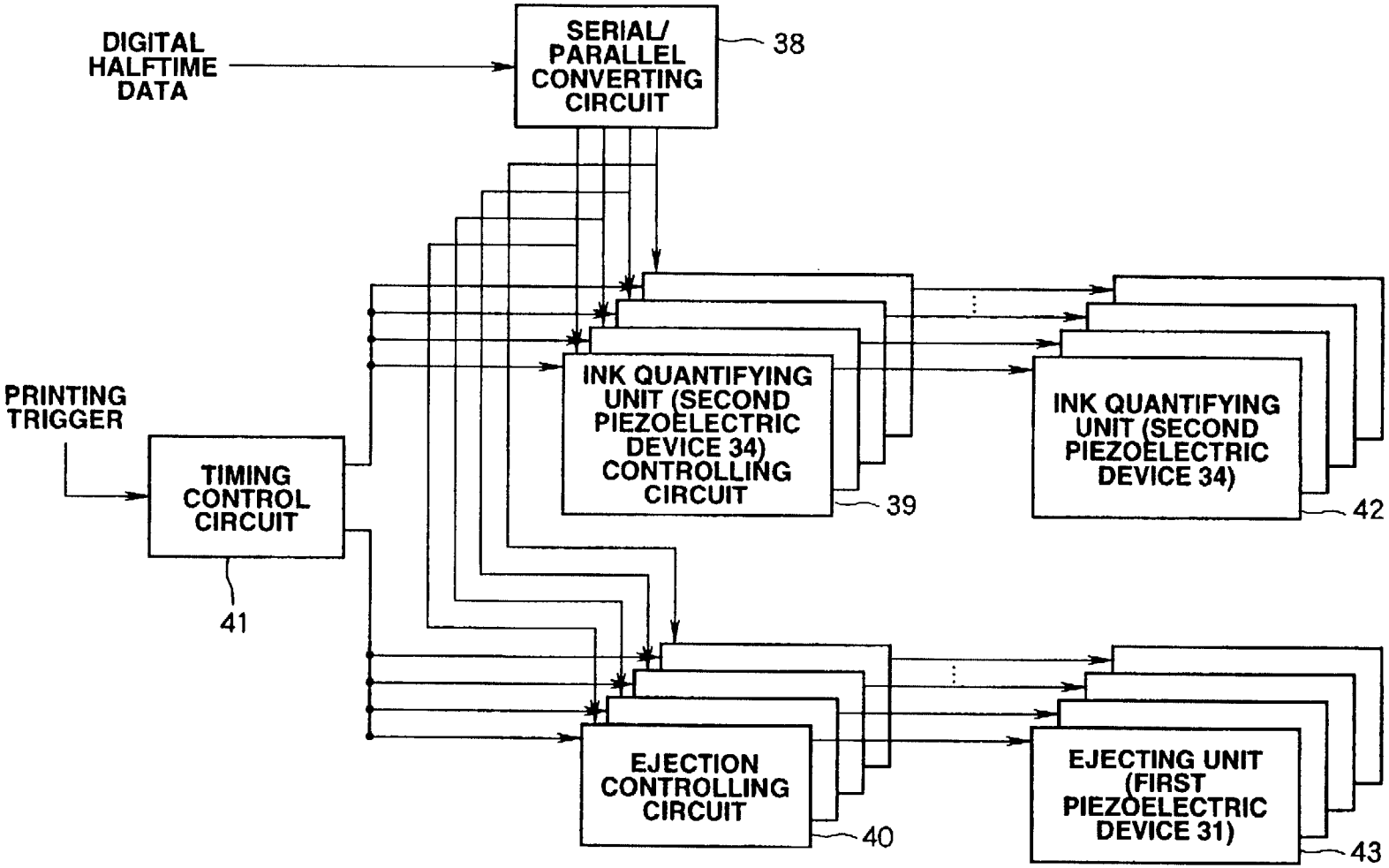
FIG. 8 is a schematic block diagram of the drive circuit employed in the liquid jet recording apparatus.

The drive circuit of this liquid jet recording apparatus is so arranged as shown in FIG. 8. The digital half tone data is supplied from other circuit block (not shown in detail) to a serial-to-parallel converting circuit 38 of this drive circuit. Then, this digital half tone data is fed from this serial/parallel converting circuit 38 to the respective ink quantifying unit (second piezoelectric device 34) controlling circuit 39 and an ejection controlling circuit 40. When the digital half tone data supplied from the serial/parallel converting circuit 38 is smaller than, or equal to a preselected threshold value, neither the ink quantifying operation, nor the ink ejecting operation is carried out. In response to the print timing, a printing trigger is outputted from other circuit block, and is detected by a timing control circuit 41 which may output at a predetermined timing, an ink quantifying unit control signal and an ejection control signal to the ink quantifying unit controlling circuit 39 and the ejection controlling circuit 40, respectively. These signals are outputted at the above-described timings as to FIG. 6 or FIG. 7. As a consequence, preselected voltages are applied to an ink quantifying unit 42 (namely, second piezoelectric device 34) and an ejecting unit 43 (namely, first piezoelectric device 31).

Figure 9:
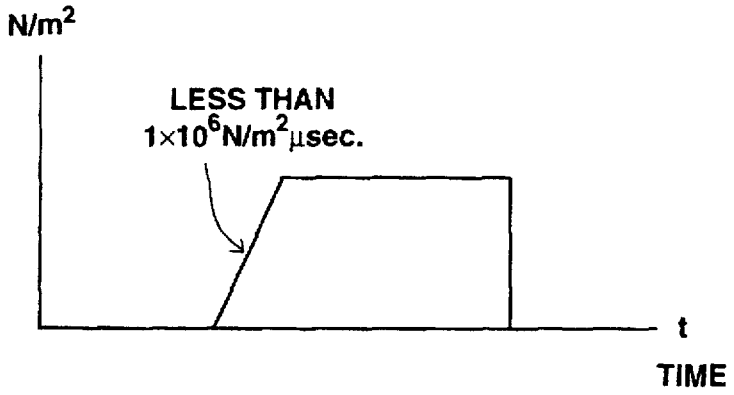
FIG. 9 schematically represents a variation in ink pressure.

On the other hand, in this liquid jet recording apparatus, when such a drive pulse whose crest value (peak value) is varied in response to the print data is applied to the second piezoelectric device 34 provided on the quantification side, the drive signal supplied from the drive circuit is controlled in such a manner that, as indicated in FIG. 9, the pressure change ratio of the ink stored in the ink fluid chamber, which is produced by this drive signal, becomes below $1\times10^6$ N/m$^2$ microsecond, irrelevant to the crest value. Otherwise, this ink pressure change rate is selected to be smaller than, or equal to $0.25\times10^6$ N/m$^2$ microsecond. When such an operation is realized, the ink extruding speed would not change the ejection direction of the dilution fluid 37, or would not eject only the ink 38, so that the fluid droplets can be continuously mixed under stable continuously ejected along the stable ejection direction.

It should be noted that this example is directed to any of the carrier jet type liquid jet recording apparatuses. Alternatively, even when this example is applied to a so-called "ink jet type liquid jet recording apparatus" in which a dilution fluid is provided on the quantification side and ink is provided on the ejection side, and then a mixture fluid made from the dilution fluid and the ink is ejected toward a recording paper or the like, a similar effect may be achieved.

FOURTH PRINTER APPARATUS

In this fourth embodiment, a description will now be made of a printer apparatus on which the above-described liquid jet recording apparatus is actually mounted.

Figure 10:
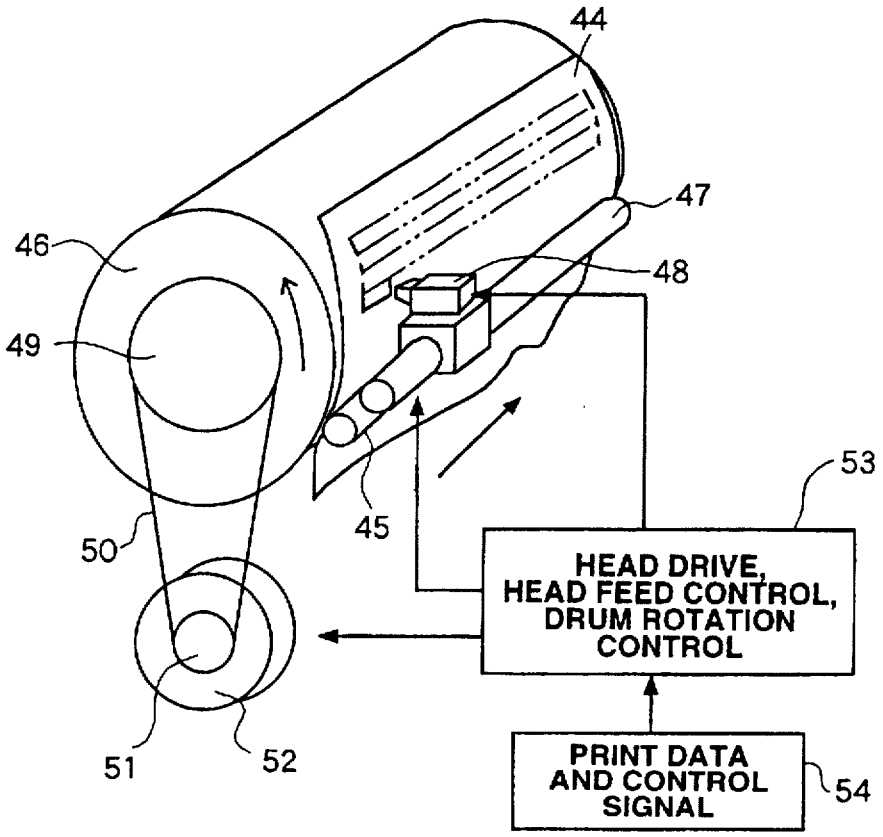
FIG. 10 schematically indicates an arrangement of a serial type printer apparatus.

As indicated in FIG. 10, the liquid jet recording apparatus is mounted on a serial type printer apparatus. A print paper 44 functioning as a printed material is held on a drum 46 under pressure by a paper pressure roller 45 provided in parallel to a drum shaft direction. A feed screw 47 is provided in parallel to the drum shaft direction near the outer peripheral portion of this drum 46. The liquid jet recording apparatus 48 is held on this feed screw 47. This liquid jet recording apparatus 48 is transported along the shaft direction of the drum 46 by rotating the feed screw 47.

On the other hand, the drum 46 is rotary-driven by a motor 52 via a pulley 40, a belt 50, and a pulley 51. Furthermore, the rotations of the feed screw 47 and the motor 52, and the drive operation of the liquid jet recording apparatus 48 are controlled by a drive control unit 53 in response to print data and a control signal 54.

With the above-described arrangement, when the liquid jet recording apparatus 48 is transported so as to print the print data for 1 line, the drum 46 is rotated only for 1 line and the print data for the next 1 line is printed. There are two printing modes when the liquid jet recording apparatus 48 is transported to perform the printing operation, namely along one way direction, and reciprocating direction.

Figure 11:
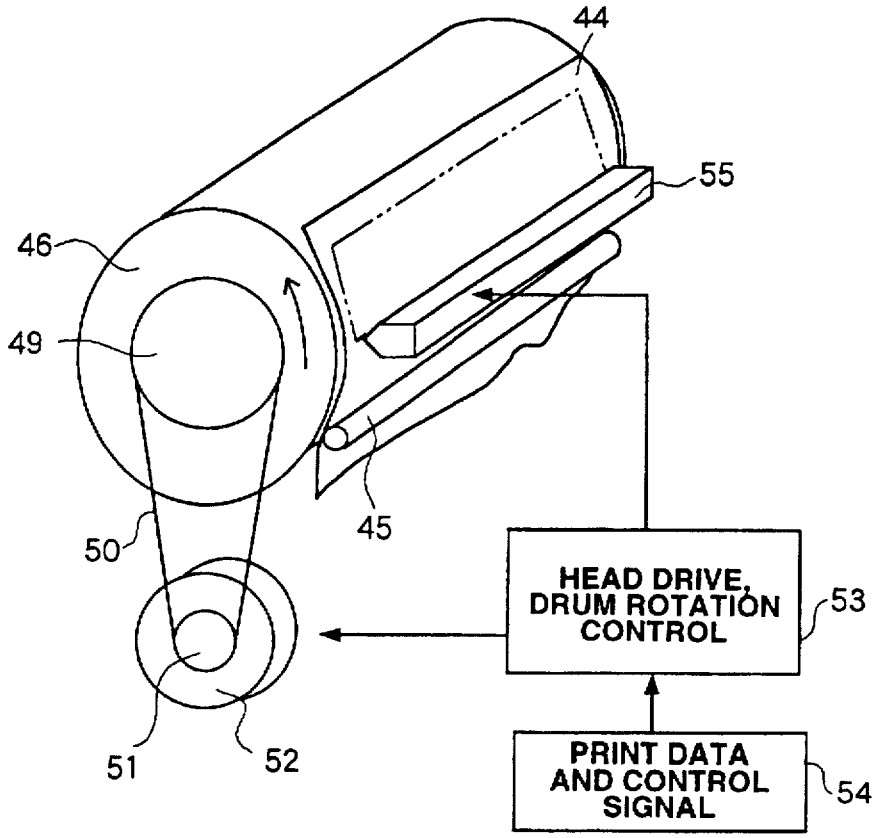
FIG. 11 schematically shows an arrangement of a line type printer apparatus.

FIG. 11 schematically shows a line type printer apparatus. In this case, such a line head 55 that a large number of a line form is fixed along the shaft direction, instead of the serial type liquid jet recording apparatus 48 and the feed screw 47 shown in FIG. 10. With this arrangement, the printing operation for 1 line is carried out at the same time by this line head 55. When this 1-line printing operation is complete, the drum 46 is rotated only for 1 line, and then the subsequent 1-line printing operation is performed. In this case, other printing methods may be conceived. That is, all of the lines may be printed out in the batch mode. Alternatively, the entire printing area is subdivided into a plurality of subblocks, and the printing operation may be performed for the respective subblocks. Furthermore, the entire printing area may be alternately printed out every two lines.

Figure 12:
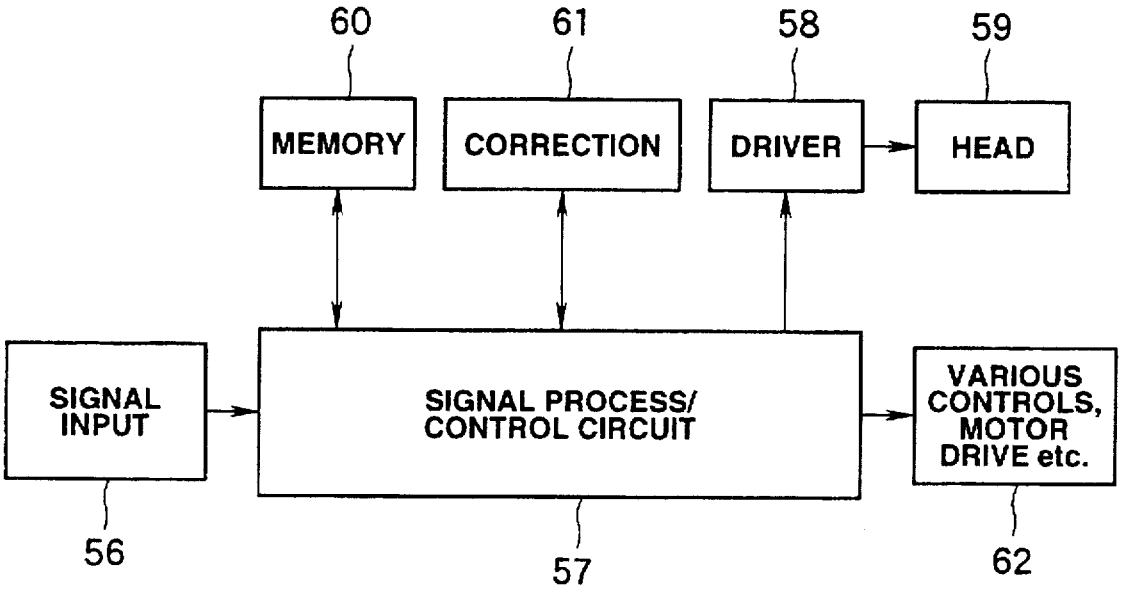
FIG. 12 is a schematic block diagram for showing a control system of the liquid jet recording apparatus.

FIG. 12 is a schematic block diagram for showing the print system and the control system. A signal 56 such as print data is inputted to a signal process/control circuit 57. The print signal 56 is processed by this signal process/control circuit 57 in such a manner that a plurality of print data are sequentially arranged, and then the processed print data are supplied via a driver 58 to a head 59. The printing sequence may be determined based upon the structures of the head 59 and of the printing unit, and also depending upon the input sequence of the print data. Thus, the print data is once stored in a memory 60 such as a line buffer, or a 1 image memory, and thereafter is read out therefrom, if required. A gradation signal and an ejection signal are inputted to the head 59.

It should be noted that when a nozzle quantity of a multi-head is very large, an IC (integrated circuit) may be employed in the head 59 so as to reduce a total number of wiring lines connected to this multi-head 59. Also, a correction circuit 61 is connected to the signal process/control circuit 57, which may perform various corrections, for instance, gamma corrections, color corrections, and fluctuation corrections of the respective heads.

In general, preselected correction data have been previously stored in a ROM by a map form, and this ROM is employed in the correcting circuit 61. Then, the proper correction data may be read out from the ROM in accordance with external conditions, for example, a nozzle number, a temperature, and an input signal. Also, generally speaking, the signal process/control circuit 57 is arranged in the form of a CPU and a DSP by way of software processing.

A various control unit 62 performs the motor drive/synchronization controls for rotating the drum 46 and the feed screw 47, the cleaning operations of the heads 48 and 55, and the supply/eject controls of the print paper 44. It should be noted that the above-described signals apparently contain the operation unit signals and the external control signals other than the above-mentioned print data.

As apparent from the foregoing descriptions, in accordance with the liquid jet recording apparatus of the present invention, since the rising speed of the pulse signal used to quantify either the ink or the dilution fluid is controlled, it is possible to perform the stable ejection/recording operations irrelevant to the quantified voltage value by the print data. As a result, such a natural image recording operation can be accomplished having the improved multi-gradation.

Also, in accordance with the liquid jet recording apparatus of the present invention, the signals applied to the piezoelectric devices are controlled in such a manner that the change ratio of the pressure given to either the ink or the dilution fluid when either the ink or the dilution fluid is quantified becomes less than $1\times10^6$ N/m$^2$ microsecond. As a consequence, it is possible to carry out the stable ejection/recording operations irrelevant to the quantified voltage value by the print data. Therefore, it is also possible to record such a natural image having more improved multi-gradation without deteriorating the recorded image.

What is claimed is:

1. A liquid jet recording apparatus for mixing a dilution liquid with ink quantified by utilizing displacement of a piezoelectric device in response to print data, and for ejecting a mixture fluid made by mixing the ink with the dilution fluid so as to perform a recording operation, wherein:

when the ink is quantified, a rising speed of a signal applied to said piezoelectric device is selected to be lower than, or equal to 1V/microsecond.

2. A liquid jet recording apparatus for mixing a dilution liquid with ink quantified by utilizing displacement of a piezoelectric device in response to print data, and for ejecting a mixture fluid made by mixing the ink with the dilution fluid so as to perform a recording operation, wherein:

when the dilution fluid is quantified, a rising speed of a signal applied to said piezoelectric device is selected to be lower than, or equal to 1V/microsecond.

3. A liquid jet recording apparatus for mixing a dilution liquid with ink quantified by utilizing displacement of a piezoelectric device in response to print data, and for ejecting a mixture fluid made by mixing the ink with the dilution fluid so as to perform a recording operation, wherein:

when the ink is quantified, a change rate of pressure given to said ink is selected to be lower than, or equal to $1\times10^6$ N/m$^2$ microsecond.

4. A liquid jet recording apparatus for mixing a dilution liquid with ink quantified by utilizing displacement of a piezoelectric device in response to print data, and for ejecting a mixture fluid made by mixing the ink with the dilution fluid so as to perform a recording operation, wherein:

when the dilution fluid is quantified, a change rate of pressure given to said dilution fluid is selected to be lower than, or equal to $1\times10^6$ N/m$^2$ microsecond.

* * * * *